United States Patent [19]

Snyder

[11] Patent Number: 4,699,586

[45] Date of Patent: Oct. 13, 1987

[54] METHOD FOR IGNITING A MULTIBURNER FURNACE

[75] Inventor: William J. Snyder, White Plains, N.Y.

[73] Assignee: Union Carbide Corporation, Danbury, Conn.

[21] Appl. No.: 863,785

[22] Filed: May 16, 1986

[51] Int. Cl.[4] ..... F23N 5/00

[52] U.S. Cl. ..... 431/6; 431/2; 431/62; 431/75; 236/1 A

[58] Field of Search ..... 431/6, 62, 63, 69, 70, 431/71, 75, 278, 174, 12; 236/1 A, 15 BR, 15 BE, 1 H; 432/12

[56] References Cited

U.S. PATENT DOCUMENTS

| | | | |
|---|---|---|---|
| 2,899,135 | 8/1959 | Engels | 236/15 BR |
| 3,393,868 | 7/1968 | Griem | 431/62 X |
| 3,894,834 | 7/1975 | Estes | 431/174 |
| 4,378,205 | 3/1983 | Anderson | 431/5 |
| 4,408,982 | 10/1983 | Kobayashi et al. | 431/10 |
| 4,431,400 | 2/1984 | Kobayashi et al. | 431/6 |
| 4,488,682 | 12/1984 | Kobayashi et al. | 239/132.3 |
| 4,525,138 | 6/1985 | Snyder et al. | 431/187 |
| 4,541,796 | 9/1985 | Anderson | 431/187 |
| 4,541,798 | 9/1985 | Miller et al. | 431/266 |
| 4,547,150 | 10/1985 | Vereecke | 431/63 X |

*Primary Examiner*—Margaret A. Focarino
*Attorney, Agent, or Firm*—Stanley Ktorides

[57] ABSTRACT

A method for igniting a multiburner furnace safely and reliably without need for an additional furnace purge if not all burners ignite initially, comprising attempting reignition at defined low firing rates and supplying fuel and oxidant to unignited burners at a high firing rate when a specified furnace temperature is reached.

16 Claims, No Drawings

METHOD FOR IGNITING A MULTIBURNER FURNACE

TECHNICAL FIELD

This invention relates to the field of multiburner furnaces and is particularly applicable to furnaces employing burners using oxygen or oxygen-enriched air as the oxidant.

BACKGROUND ART

A multiburner furnace is a furnace having two or more burners. It is important that all burners be operating so that the furnace will achieve balanced heating in accord with its design. Furthermore, the supply of fuel and oxidant to an unlit burner could cause unsafe and inefficient operation of the furnace.

In a multiburner furnace having conventional burners wherein air is the oxidant, a problem with unlit burners generally does not arise. This is because such air burners are typically placed close together and should a burner fail to be ignited by its ignition system it will be ignited by the adjacent burner. In fact, often in such a system, one burner is ignited manually and this ignited burner will cause all the other burners in the multiburner furnace to become ignited.

A recent significant advance in the burner art is the burner described and claimed in U.S. Pat. No. 4,541,796 to Anderson which employs oxygen or oxygen-enriched air as the oxidant. This burner, as well as other oxygen burners, may be employed in multiburner furnaces, but, when so employed, the potential for certain problems, which does not arise with the use of air burners, come into being if less than all of the burners successfully ignite.

Because of the inherent higher efficiency of oxygen burners over that of air burners, fewer oxygen burners are needed for each furnace and thus oxygen burners are spaced farther apart than are air burners. This results in the inability of an unlit burner to be ignited by an adjacent firing burner due to the large distance between them. Furthermore, should one or more burners fail to ignite or become extinguished during operation, the entire furnace, including all of the ignited burners, must be shut down and the furnace zone repurged with air or an inert gas, because of the increased danger posed by uncombusted fuel mixing with the oxidant. This shutdown of the ignited burners and the repurging of the furnace zone is time consuming and costly.

It is therefore an object of this invention to provide a method for igniting all burners in a multiburner furnace without need to shut down ignited burners when less than all burners ignite initially.

SUMMARY OF THE INVENTION

The above and other objects which will become apparent to one skilled in the art upon a reading of this disclosure are attained by the method of this invention, one aspect of which is:

A method for igniting all burners in a multiburner furnace without need to shut down ignited burners when less than all burners ignite initially comprising:

(A) monitoring the temperature within the furnace;

(B) supplying fuel and oxidant at a low firing rate to each burner and attempting ignition of each burner;

(C) while continuing to fire the ignited burner(s) at a low firing rate, discontinuing the flow of fuel and oxidant to each unlit burner and thereafter restarting the flow of fuel and oxidant to each unlit burner at a low firing rate and attempting ignition of each unlit burner;

(D) periodically repeating step (C) until sufficient burners have ignited to enable firing at the high fire rate;

(E) discontinuing the flow of fuel and oxidant to the unignited burner(s) and supplying fuel and oxidant to the ignited burner(s) at a high firing rate until the furnace temperature is at or above the autoignition temperature; and thereafter (F) supplying fuel and oxidant to all burners at a high firing rate.

A further aspect of the method of this invention is:

A method for igniting all burners in a multiburner furnace without need to shut down ignited burners when less than all burners ignite initially, comprising:

(A) monitoring the temperature within the furnace;

(B) supplying fuel and oxidant at a low firing rate to each burner and attempting ignition of each burner;

(C) discontinuing the flow of fuel and oxidant to the unignited burner(s) and supplying fuel and oxidant to the ignited burner(s) at a high firing rate until the furnace temperature is at or above the autoignition temperature; and thereafter (D) supplying fuel and oxidant to all burners at a high firing rate.

As used herein, the term "firing rate" is used to mean the energy input rate to a furnace, typically through a single burner, generally stated in Million BTU (MMBTU), or Kilocalories (KCAL), per House (HR).

As used herein, the term "low firing rate" is used to mean a firing rate of a burner that is less than 5 percent of the burner's maximum rated firing capacity.

As used herein, the term "high firing rate" is used to mean a firing rate within the range of which the burner is intended to operate under normal conditions and is generally within the range of from 20 to 100 percent of a burner's rated capacity.

As used herein, the term "autoignition temperature" is used to mean the temperature at which a combustible mixture will burn spontaneously without the need of an ignition source. The NFPA recommended autoignition temperature for industrial furnaces is 1400° F.

DETAILED DESCRIPTION

The method of this invention is applicable to all burners employing air, oxygen-enriched air, or oxygen. However, the advantages of the invention are most beneficial when oxygen or oxygen-enriched air are employed as the oxidant. Oxygen-enriched air comprises at least 22 percent oxygen, and for purposes of this invention, preferably comprises at least 25 percent oxygen.

In the method of this invention, fuel and oxidant are supplied to each burner of the multiburner furnace at a controllable rate. The fuel and oxidant may be premixed upstream or within the burner or may be injected into the furnace zone separately and post-mixed after injection.

Any flowable fuel may be employed in the method of this invention and among such fuels one can name gaseous fuels such as natural gas, methane, or coke oven gas, liquid fuels such as oil and coal-water mixtures or solid fuels such as pulverized coal and wood chips.

The multiburner furnace will have at least two burners and may have any practical number of individual burners. Generally a multiburner furnace will have from 4 to 20 individual burners.

Each burner employed in the method of this invention has its own interrupted ignition device to ignite the burner as well as its own flame monitoring system and valves to shut off flow of fuel and oxidant to the burner. Ignition devices are well known to those skilled in the art and no further discussion of ignition devices is necessary here. When the burner is a post-mixed burner, a preferred ignition device is the ignition system disclosed and claimed in U.S. Pat. No. 4,431,400 to Kobayashi et al.

In the method of his invention, fuel and oxidant are supplied to each burner at a low firing rate and ignition of each burner is attempted. Preferably the ignition of each burner is attempted simultaneously. Typically the low firing rate is within the range of from 200,000 to 500,000 British Thermal Units per Hour (BTU/hr).

The temperature within the furnace zone is monitored by use of any suitable temperature monitoring device such as a thermocouple. Those skilled in the art are familiar with the use of thermocouples or other temperature measurement devices to monitor furnace temperature and no further discussion of this step is necessary here.

When attempting ignition of a burner the fuel and oxidant are turned on at a low firing rate and the ignition device is turned on. If the burner has not lit within preferably about fifteen seconds, both the igniter and the fuel and oxidant flows are turned off.

While all of the ignited burners are continually fired at a low firing rate, and without shutting down any of these ignited burners, fuel and oxidant flow at a low firing rate is restarted to each unlit burner and ignition is attempted again for each of the unlit burners. Preferably the ignition of each unlit burner is attempted simultaneously. For those that fail to ignite on the second attempt, the ignition sequence is repeated while all ignited burners continue firing at the low fire rate. It is believed that up to 5 reignition attempts may be carried out without need for a furnace repurge although this number would depend on the size of the furnace and on the flowrates of fuel and oxidant under low fire conditions. This procedure continues until a sufficient number have ignited to enable firing at a high firing rate. By "to enable firing at the high firing rate" it is meant that the control system will be able to maintain the proper oxidant fuel ratio with the reduced number of burners operating and that sufficient energy input can be supplied to raise the furnace temperature to the autoignition temperature in a reasonable amount of time. Typically the condition is met when at least one-half of the burners have ignited. Thereafter fuel and oxidant flow is discontinued to the unignited burners and the ignited burners are fired at a high firing rate until the autoignition temperature is attained within the furnace, whereupon fuel and oxidant at a high firing rate is supplied to the unignited burners as well as to the ignited burners, resulting in all burners firing at a high firing rate. Typically the high firing rate is within the range of from 2 to 10 million BTU/hr per burner. The autoignition temperature will vary with the type of fuel used and with the concentration of oxygen in the oxidant as well as other factors known to those skilled in the art.

In a variation of the method of this invention, which may be used when a sufficient number of burners have ignited on the first ignition attempt to enable firing at the high firing rate, the unignited burners are shut down and the ignited burners are fired at a high firing rate until the autoignition temperature is attained within the furnace, whereupon fuel and oxidant at a high firing rate is supplied to the unignited burners as well as to the ignited burners, resulting in all burners firing at a high firing rate.

The method of this invention may be further illustrated by the following nonlimiting example. An industrial furnace comprising six individual burners was fired with coke oven gas as the fuel and pure oxygen as the oxidant. The furnace temperature was monitored using a thermocouple connected to an on/off temperature controller. The temperature at which autoignition was allowed for this fuel and oxidant was set at 1400° F. Coke oven gas and oxygen were supplied to each burner at 1000 $ft^3$/hr and 1000 $ft^3$/hr respectively for a low firing rate of 500,000 BTU/hr and ignition was attempted for each burner. Ignition is reattempted for each unignited burner until four burners are ignited. Fuel and oxidant flow to the unignited burners was discontinued and coke oven gas and oxygen were supplied to each lighted burner at 12000 $ft^3$/hr and 12000 $ft^3$/hr respectively for a high firing rate of six million BTU/hr until the furnace temperature reached the autoignition temperature whereupon coke oven gas and oxygen were supplied to each burner at the high firing rate. The unignited burners ignited and all burners were operating without the need of an additional furnace purge beyond the initial furnace purge carried out prior to the start of the ignition sequence.

Now by the use of the method of this invention, one can reliably ignite all burners in a multiburner furnace without need to shut down ignited burners and purge the furnace of uncombusted fuel and oxidant if some of the burners fail to ignite. The method of this invention comprising carrying out certain specific steps under conditions of low fire, and supplying fuel and oxidant at a high fire rate to unlit burners when the furnace reaches autoignition temperature and firing such burners without need for ignition by an ignition device, allows one to safely carry out complete ignition, even with pure oxygen as the oxidant, without need for repeating the furnace purge operation.

I claim:

1. A method for igniting all burners in a multiburner furnace without need to shut down ignited burners when less than all burners ignite initially, wherein each burner has its own interrupted ignition device and valves to shut off flow of fuel and oxidant to the burner, comprising:

(A) monitoring the temperature within the furnace;

(B) supplying fuel and oxidant at a low firing rate to each burner and attempting ignition of each burner;

(C) while continuing to fire the ignited burner(s) at a low firing rate, discontinuing the flow of fuel and oxidant to each unlit burner and thereafter restarting the flow of fuel and oxidant to each unlit burner at a low firing rate and attempting ignition of each unlit burner;

(D) periodically repeating step (C) until sufficient burners have ignited to enable firing at the high fire rate;

(E) discontinuing the flow of fuel and oxidant to the unignited burner(s) and supplying fuel and oxidant to the ignited burner(s) at a high firing rate until the furnace temperature is at or above the autoignition temperature; and thereafter (F) supplying fuel and oxidant to all burners at a high firing rate.

2. The method of claim 1 wherein the oxidant is oxygen.

3. The method of claim 1 wherein the oxidant is oxygen-enriched air.

4. The method of claim 1 wherein the low firing rate is within the range of from 200,000 to 500,000 BTU/hr.

5. The method of claim 1 wherein the high firing rate is within the range of from 2 to 10 million BTU/hr.

6. The method of claim 7 wherein the autoignition temperature is at least 1400° F.

7. The method of claim 1 wherein step (c) is repeated up to five times.

8. The method of claim 1 wherein the multiburner furnace comprises from 4 to 20 burners.

9. The method of claim 1 wherein the sufficient number of burners to enable firing at the high firing rate is at least one-half of the burners of the multiburner furnace.

10. A method for igniting all burners in a multiburner furnace without need to shut down ignited burners when less than all burners ignite initially, wherein each burner has its own interrupted ignition device and valves to shut off flow of fuel and oxidant to the burner, comprising:

(A) monitoring the temperature within the furnace;

(B) supplying fuel and oxidant at a low firing rate to each burner and attempting ignition of each burner;

(C) discontinuing the flow of fuel and oxidant to the unignited burner(s) and supplying fuel and oxidant to the ignited burner(s) at a high firing rate until the furnace temperature is at or above the autoignition temperature; and thereafter (D) supplying fuel and oxidant to all burners at a high firing rate.

11. The method of claim 10 wherein the oxidant is oxygen.

12. The method of claim 10 wherein the oxidant is oxygen-enriched air.

13. The method of claim 10 wherein the low firing rate is within the range of from 200,000 to 500,000 BTU/hr.

14. The method of claim 10 wherein the high firing rate is within the range of from 2 to 10 million BTU/hr.

15. The method of claim 10 wherein the autoignition temperature is at least 1400° F.

16. The method of claim 10 wherein the multiburner furnace comprises from 4 to 20 burners.

* * * * *

UNITED STATES PATENT AND TRADEMARK OFFICE

CERTIFICATE OF CORRECTION

PATENT NO. : 4,699,586

DATED : October 13, 1987

INVENTOR(S) : W.J. Snyder

It is certified that error appears in the above-identified patent and that said Letters Patent is hereby corrected as shown below:

In column 1, line 34 delete "come" and insert therefor --comes--.

In column 2, line 34 delete "House" and insert therefor --Hour--.

In claim 6, line 1 delete "7" and insert therefor --1--.

Signed and Sealed this

Fifth Day of April, 1988

*Attest:*

*Attesting Officer*

DONALD J. QUIGG

*Commissioner of Patents and Trademarks*